United States Patent [19]

Ricci

[11] Patent Number: 4,841,751

[45] Date of Patent: Jun. 27, 1989

[54] APPARATUS FOR TREATING FABRICS AND FABRIC GARMENTS

[75] Inventor: Francesco Ricci, Forli, Italy

[73] Assignee: Golden Trade S.r.l., Forli, Italy

[21] Appl. No.: 224,588

[22] Filed: Jul. 27, 1988

[30] Foreign Application Priority Data

Jul. 31, 1987 [IT] Italy ..... 3588 A/87

[51] Int. Cl.[4] ..... D06B 1/12

[52] U.S. Cl. ..... 68/29; 51/164.1; 68/139; 68/146

[58] Field of Search ..... 8/158, 159, 102, 108.1, 8/137; 68/29, 30, 139, 142, 144, 146; 51/164.1, 164.5, 313, 317

[56] References Cited

U.S. PATENT DOCUMENTS 4,218,220 8/1980 Kappler et al. ..... 8/102
4,575,887 3/1986 Viramontes ..... 8/159 X
4,740,213 4/1988 Ricci ..... 8/108.1
4,750,227 6/1988 Hopkins et al. ..... 8/158
4,765,100 8/1988 Majors ..... 8/159 X

*Primary Examiner*—Philip R. Coe
*Attorney, Agent, or Firm*—Bryan, Cave, McPheeters & McRoberts

[57] ABSTRACT

The apparatus of the invention allows for efficient and safe decolorizing or dyeing of cloth articles using bleach or dye-impregnated stones or granules. The apparatus includes a cylindrical drum with longitudinal baffles along its inner surface. Liner sheets are attached to adjacent baffles, thereby lining the entire drum. The sheets flex inwardly due to gravity as the drum is rotated, thereby dislodging any residual materials layered thereon. The apparatus also provides for separation of treated articles from stones and re-impregnation of the stones with a bleaching agent or a dyestuff solution or dispersion.

13 Claims, 2 Drawing Sheets

APPARATUS FOR TREATING FABRICS AND FABRIC GARMENTS

BACKGROUND OF THE INVENTION

1. Field of the Invention

The present invention relates to an apparatus for decolorizing, i.e., fading or "aging," cloth articles, e.g., denim jeans, or for coloring cloth articles. The present invention also relates to a method for operating the apparatus.

2. Description of the Prior Art

A method for decolorizing or aging of denim articles by "stone washing" has been known for some time. Stone washing involves immersing articles of clothing in water or in an aqueous bath containing a base, e.g., a hypochlorite solution, together with small stones or granules of pumice. The pumice stones generally have an average diameter or length on one side of about 1–10 cm. Stone washing produces a clothing article having light-dark shadings at the seams and a uniformly recurring color contrast which is typical of natural wear over the rest of the article.

A method is also known for treating, i.e., decolorizing or fading, cloth articles without immersion in an aqueous bath as in stone washing. This method was also invented by the present applicant and is described in U.S. Pat. No. 4,740,213, the disclosure of which is hereby incorporated by reference. The method involves contacting cloth articles with a coarse, permeable material, e.g., pumice granules, small stones of a technically equivalent material, or granules obtained by compressing paper or the like, the permeable material having been first impregnated with a bleaching agent. The cloth articles may be dry or wet, e.g., damp, when contacted with the impregnated coarse, permeable material, and the contact is generally for a time sufficient to achieve the desired effect.

According to this method, unique faded effects may be achieved on cloth articles, e.g., denim fabrics. For example, cloth articles having random areas of high color contrast due to localized dye removal may be obtained. The random areas may combine a form wisp-like, cloud-like, or smoke-like abstractions which are atypical of normal wear.

In addition to the unique effects which may be achieved, substantial economic advantages may be realized in the treatment of clothing articles by this method. In particular, as compared to conventional stone washing, this method results in significant water, bleach and stone or granule savings. Moreover, the cloth fibers of the articles are subjected to a less severe mechanical action as compared to stone washing and, as a result, articles treated by the method described in U.S. Pat. No. 4,740,213 generally have less fiber degradation.

The present applicant has also disclosed in copending application Ser. No. 151,479, a method for dyeing a textile in a non-uniform manner, the disclosure of which is hereby incorporated by reference. This method involves contacting the textile with rigid, coarse, permeable granules that have been impregnated with a dyestuff. The textile and granules are contacted while in relative random movement with respect to one another for a time sufficient to achieve the desired effect. This method is particularly advantageous because non-uniform, discontinuous, or random, maculated dyeings may be achieved which are not possible by known dyeing methods.

The methods described in U.S. Pat. No. 4,740,213 and U.S. patent application Ser. No. 151,479, are presently accomplished in industrial batch laundry drums with rotating baskets. The cloth articles are placed within the basket with stones or granules impregnated with a bleaching agent or a dyestuff. The duration of the cycle is determined by the type of cloth article and the desired effect. At the end of each treatment cycle, the treated articles must be manually removed from the basket and separated from the granules employed. In the case of cloth articles treated with bleach-impregnated granules, the separated articles are generally fed to a washing operation to neutralize any residual bleach. In the case of contact with dye-impregnated granules, the separated cloth articles may be thermally treated to fix the dyestuff to the article and aqueous washed to remove any excess dyestuff.

Industrial washing machines are limited to the treatment of a batch of a given quantity of cloth articles, usually 5–20 kg. Each time a new cycle is to be run, granules must be impregnated with bleaching agent or dyestuff. At the conclusion of the process, the emptying of the machine and separation of the articles from the granules is an inconvenient and laborious process, posing health and safety risks.

SUMMARY OF THE INVENTION

The apparatus of the present invention may be used to bleach or dye cloth articles, and it includes:

(a) a longitudinally-extending cylindrical drum, which drum has an extrance mouth and a discharge end;

(b) means for rotating the drum;

(c) means for inclining said drum relative to the horizontal plane;

(d) means for feeding cloth articles to the entrance mouth of the drum;

(e) means for feeding stones or granules to the entrance mouth of the drum;

(f) means for separating the cloth articles from the stones or granules at the discharge end of the drum; and (g) means for recycling stones or granules from the discharge end to the entrance mouth of the drum, the recycling means further comprising means for impregnating the stones or granules with a bleaching agent or a dyestuff solution.

The cylindrical drum of the apparatus also includes at least three longitudinally-extending baffles attached to its inner surface, the baffles being spaced around the inner circumference of the drum. Each of the baffles extends radially toward the center of the drum and is of sufficient depth that as the drum is rotated, the baffles serve to lift articles contained in the drum. The drum also has impervious, flexible liner sheets, the number of impervious sheets being equal to the number of baffles. Each of the sheets extends between and is attached to adjacent baffles, the sheets being periodically flexed inwardly toward the center of the drum as the drum is rotated by the effect of gravity, thereby dislodging residual materials from the surface of the sheets.

The apparatus of the present invention thus allows for continuous treatment of cloth articles, without interruptions due to loading and removal of articles before and after the treatment cycle. The apparatus also provides for the continuous recovery of the stones or granules employed in the treatment. The recovered stones or granules may be returned to the entrance of the drum after a screening operation to remove undesirably small particles and dust. The recovered stones may be impregnated with a bleaching agent or a dyestuff before being reintroduced to the chamber.

BRIEF DESCRIPTION OF THE DRAWINGS

The characteristics of the apparatus of the present invention are more easily understood by reference to the following description taken in conjunction with the accompanying drawings, in which.

DETAILED DESCRIPTION OF THE INVENTION

Figure 1:
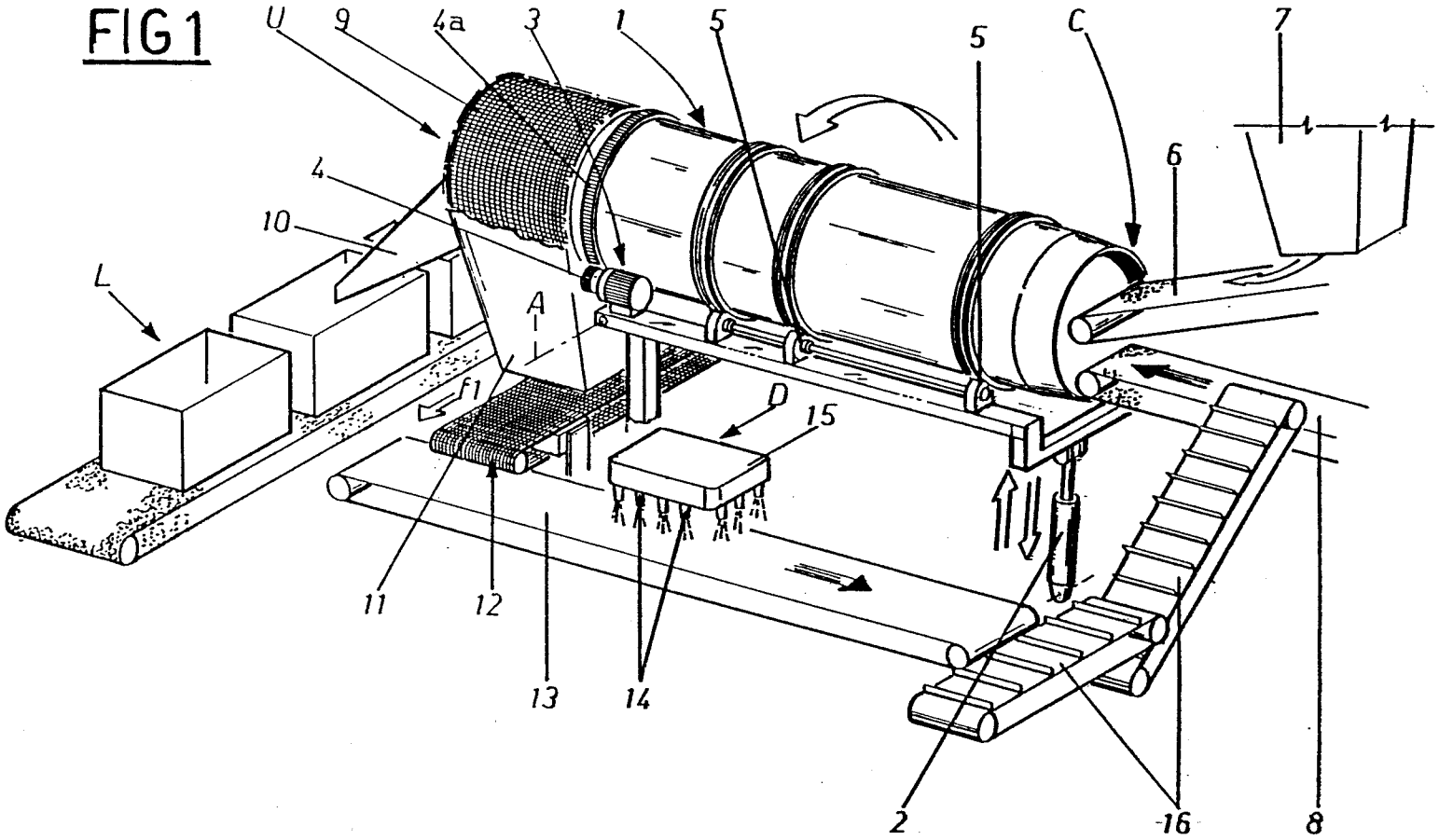
FIG. 1 is a diagram in perspective of the apparatus of the present invention.

The present invention provides an apparatus for continuous treatment of cloth articles which improves the processing time and efficiency for the decolorization and dying methods described above, and which greatly reduces health and safety risks associated therewith. The apparatus allows for the introduction of articles of clothing and stones into a mouth at one end of a cylindrical, rotating drum. The articles and stones are advanced through the drum at a rate dependent on the rotational speed of the drum and its degree of inclination.

A rotating basket is located at the outlet of the drum for separation of the articles from the stones, thereby permitting separate collection of the treated articles. The rotating basket permits the automatic expulsion or evacuation of the stones from the chamber through holes or a mesh in the wall of the rotating basket walls. The rotating basket, in combination with the rotating drum, makes it possible to automatically collect treated clothing articles because the basket generally rotates at the same inclination and in the same manner as the rotating drum, thereby axially advancing the articles. The stones and the treated articles may thus be separately collected in recovery hoppers, with the stones being re-impregnated and returned to the entrance mouth of the drum.

The treated articles may thus be sent to subsequent washing or thermal dye-fixing operations without manual intervention. The elimination of manual intervention results in significant economic and health advantages, because it is not necessary for an operator to act on the treated clothing articles which are still impregnated with chemical bleaching substances or dyestuffs.

The apparatus of the present invention also automatically cleans residual materials from the drum which deposit on its inside surface, e.g., due to the scaling or grinding of the stones or granules used as a carrier for the bleaching agent or the dyestuff. These residues, if not eliminated, would gradually form multiple layers on the drum walls, thereby decreasing the cross-sectional area available for passage of the clothing articles. The residues would most likely also have an undesirable effect on the cloth treatment. Ultimately, a point would be reached without an automatic cleaning means when it would be necessary to shut down the operation to clean the drum.

Turning to the figures, the apparatus of the present invention includes a drum 1 supported by a frame (not shown), the inclination of which is controlled by elevation-control means, e.g., a hydraulic piston 2. Drum 1 is typically about 1 to 20 meters in length and has a diameter of about 0.5 to 5.0 meters. Actuation of hydraulic piston 2 makes it possible to vary the inclination of the drum 1 with respect to the horizontal plane, generally at angles of 0° to 45° relative to the horizontal plane.

Drum 1 is placed in rotation by a geared motor/speed unit 3 on the output shaft of which is keyed a pulley or tooth pinion 4, which engages a corresponding meshing means on the drum 1, for instance, a tooth ring 4A. Preferably, motor/speed unit 3 is able to rotate drum 1 both clockwise and counter-clockwise, as desired.

Drum 1 is supported by the frame via a series of stationary support rollers 5 adapted to secure drum 1 in the axial direction, thereby preventing the drum from shifting with respect to the frame.

Drum 1 is open at the end facing Zone C to allow for the loading of the articles to be treated. Two conveyors are located in Zone C:

a first conveyor 6 for feeding cloth articles from a hopper 7 to drum 1; and a second conveyor 8 forming part of the regeneration or re-impregnation line for the stones or granules, as discussed below.

The stones or granules, after they have been impregnated with a bleaching agent or a dyestuff solution or dispersion, may thus be introduced to drum 1 simultaneously with the articles to be treated. Cloth articles are generally fed to drum 1 at a rate of 1 to 50 pieces per minute. The rate at which the stones or granules are fed to drum 1 will depend in part on the desired effect and the rate at which cloth articles are being fed, as will be apparent to one or ordinary skill in the art.

Reproducibility and control of the cloth article treatments accomplished in the apparatus of the present invention may be improved by regulation of the temperature and humidity conditions in drum 1. Thus, drum 1 may be equipped with an air conditioner (not pictured), e.g., at the top of drum 1, or the room in which the apparatus is located may be air conditioned.

In Region U at the discharge end of the drum, i.e., where the cloth articles exit from drum 1, is a basket 9 which, in the case shown, is an extension of drum 1 itself. The surrounding or cylindrical wall of basket 9 is made in such a manner as to form a drum screen, the holes or meshes of which are of a cross section substantially greater than the size of the stones or granules, e.g., pumice granules or the like, used for the treatment of the cloth articles. However, the cross-sectional area of the meshes is also selected so as not to allow cloth articles to pass therethrough during normal operation. Whether or not basket 9 is an extension of drum 1, the entrance to basket 9 is in direct communication with the outlet of drum 1. A chute 10 is provided at the outlet of basket 9 through which the treated articles are transferred to collection containers supported by or associated with a line L for transfer to subsequent washing, thermal fixing, or like operations.

Below basket 9 is a hopper 11 for collection of the stones or granules which fall from basket 9. Below hopper 11 is a vibrating-screen conveyor with metal netting 12 onto which the stones pass from hopper 11.

The vibrating-screen conveyor 12 moves in the direction indicated by arrow F1. The meshes of its netting are slightly smaller in cross section than the sizes of the stones or granules employed. As will be apparent to one of ordinary skill in the art, acceptable stone and granule sizes will vary depending on the desired effect on the clothing article and, accordingly, the screen size may be varied.

The vibrating-screen conveyor 12 discharged onto another conveyor 13 which operates substantially perpendicular to conveyor 12 and parallel to drum 1. Conveyor 13 passes below an operating station D which contains a series of spray nozzles 14 directed at the upper surface of conveyor 13. Spray nozzles 14 are connected to a tank 15 which contains the bleaching agent or the dyestuff solution or dispersion for use in impregnating the stones or granules to be sent to conveyor 8. The fluid fed to spray nozzles 14 is generally pressurized to a pressure of 1–10 atm. Conveyor 13 discharges onto a further pair of elevating conveyors 16 by which the re-impregnated stones are fed to conveyor 8 and ultimately to drum 1.

Figure 2:
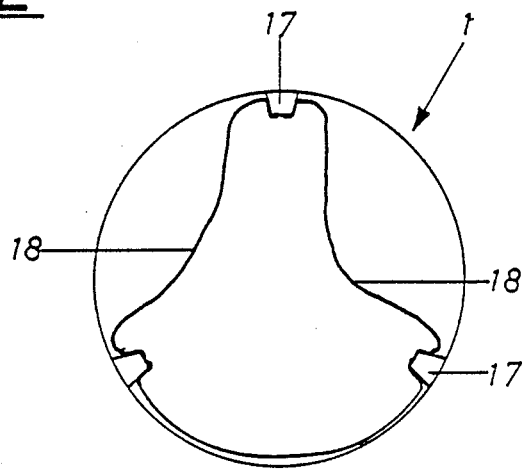
FIG. 2 is a sectional view of the drum with the inner lining shown in three different conditions.
Figure 3:
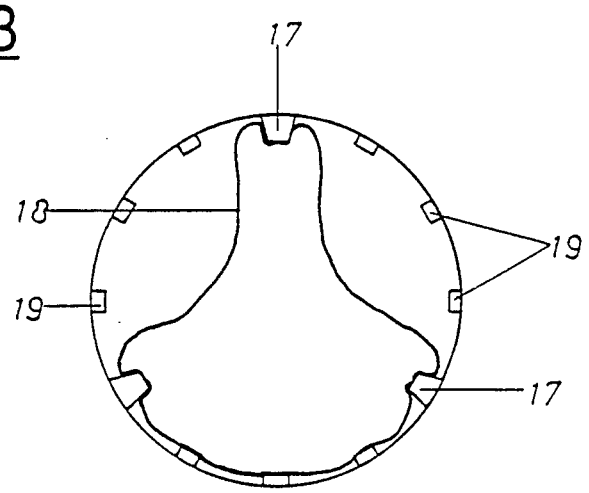
FIG. 3 is a variation of the drum shown in FIG. 2.

With particular reference to FIGS. 2 and 3, drum 1 is provided longitudinally with three baffles or projections 17 which are shown in cross section and which project toward the inside of the drum. Baffles 17 are of sufficient depth that, as drum 1 is rotated, baffles 17 lift cloth articles, granules or both, contained in the drum. Thus, baffles 17 serve to lift and therefore rotate the cloth articles and the stones inside drum 1.

Strips 18 of rubberized cloth or other similar material are fastened to both sides of baffles 17. Strips 18 may comprise the same number of panels as there are baffles 17, each individual strip panel being attached to adjacent baffles 17, or strips 18 may comprise a single panel which extends around the entire inner circumference of drum 1 and is attached to adjacent projections 17, thereby lining the complete inner surface of drum 1. In either case, strips 18 form a lining which protects the inner surface of drum 1. Strips 18 and drum 1 are connected only along the longitudinal edges of baffles 17.

As the drum rotates, each section or panel of strip 18 located between each pair of baffles 17 is periodically located at the upper point of the rotation of drum 1. At or near this point, gravity forces that section or panel of strip 18 to drop down towards the inside of the drum, thereby flexing that section or panel inwardly and freeing residual materials from the surface of strip 18.

In order to prevent strips 18 from remaining attached to the inner surface of the shell of drum 1, the inner surface may be provided with longitudinal reliefs 19 between baffles or projections 17. Longitudinal reliefs 19 tend to move strips 18 away from the inner surface of drum 1. As an alternative, drum 1 may have perforations in its shell which may serve to equalize the pressure between the outside and the inside of the drum, and in particular between the inside of the drum and the space which is formed between the inner surface of the drum itself and the strips 18. This pressure equalization may prevent strips 18 from remaining attached to the inner surface of drum 1.

The typical operation of the apparatus may be described as follows. Cloth articles and stones which are impregnated with a bleaching agent or a dyestuff solution or dispersion are introduced substantially simultaneously into drum 1 by conveyors 7 and 8. The cloth articles and stones are intimately mixed as a result of the rotation of drum 1 and its inclination with respect to the horizontal plane which is regulated by means of piston 2. The resultant random contact between stone and cloth causes an irregular or random fading or dyeing of the cloth distributed across the entire surface of the article.

When the cloth articles and the stones reach the outlet Region U and particularly basket 9, the continued rotation of drum 1 and of the basket 9 allows the stones to gradually fall into hopper 11. From hopper 11, the stones are fed onto vibrating-screen conveyor 12. Meanwhile, the cloth articles advance toward chute 10 and fall into the containers advanced by line L. The recovered stones are carried on conveyor 13 and pass through station D, where nozzles 14 re-impregnate them with bleaching agent or dyestuff solution or dispersion. The re-impregnated stones are fed to conveyor 8 and then into drum 1 along with additional cloth articles which continue to enter on conveyor 7.

As a result of the rotation of drum 1 and the contact between the granules, the cloth articles, and the inner surface of drum 1, dust from crushed granules, small particles and sludge are formed in drum 1. These residual materials are periodically dropped or tossed towards the inside of the drum by strips 18 as a result of strip 18 being drawn by gravity toward the center of the drum. Thus, the residual materials are automatically freed from the surface of strips 18 and are thereby made available to freely contact the cloth articles along the entire length of drum 1 until arriving in basket 9. From basket 9, this residual material along with the remaining granules are discharged from the drum through chute 11, thereby leaving the drum in optimum condition for operation at all times.

Having thus described the invention, what is claimed is:

1. An apparatus for use in bleaching or dyeing cloth articles, comprising:

(a) a longitudinally-extending cylindrical drum, said drum having an entrance mouth and a discharge end;

(b) means for rotating said drum;

(c) means for inclining said drum relative to the horizontal plane;

(d) means for feeding cloth articles to the entrance mouth of the drum;

(e) means for feeding stones or granules to the entrance mouth of the drum;

(f) means for separating the cloth articles from the stones or granules at the discharge end of the drum; and (g) means for recycling stones or granules from the discharge end to the entrance mouth of the drum, said recycling means further comprising means for impregnating the stones or granules with a bleaching agent or a dyestuff solution;

said cylindrical drum, further comprising at least three longitudinally-extending baffles attached to its inner surface, said baffles being spaced around the inner circumference of the drum, each of said baffles extending radially toward the center of the drum and being of sufficient depth that as said drum is rotated, said baffles serve to lift articles contained in the drum; and said drum further comprising impervious, flexible liner sheets, the number of impervious sheets being equal to the number of baffles, each of said sheets extending between and attached to adjacent baffles, said sheets being periodically flexed inwardly toward the center of the drum as the drum is rotated by the effect of gravity, thereby dislodging residual materials from the surface of said sheets.

2. The apparatus of claim 1, wherein said rotation means rotates said drum in both directions.

3. The apparatus of claim 1, wherein said inclining means is a piston and said drum is inclined from 0° to 45° relative to the horizontal plane.

4. The apparatus of claim 1, wherein said drum is 1 to 20 meters in length and 0.5 to 5 meters in diameter.

5. The apparatus of claim 1, wherein said means for feeding cloth articles, said means for feeding granules and said means for recycling stones are conveyors.

6. The apparatus of claim 1, wherein said separation means is a cylindrical basket having a mesh wall.

7. The apparatus of claim 6, wherein said mesh is of a larger diameter than the stones fed to the drum, but not so large as to allow the cloth articles to pass therethrough.

8. The apparatus of claim 6, wherein said basket is an extension of the cylindrical drum.

9. The apparatus of claim 1, wherein said impregnating means comprises spray nozzles.

10. The apparatus of claim 9, wherein said recycling means is a conveyor and said spray nozzles are positioned above said conveyor.

11. The apparatus of claim 1, further comprising an air conditioner attached to said drum.

12. The apparatus of claim 1, further comprising perforations through the surface of said drum between said baffles.

13. The apparatus of claim 1, further comprising longitudinal reliefs on the inner surface of said drum between said baffles.

* * * * *